United States Patent [19]

Logan

[11] Patent Number: 4,556,857

[45] Date of Patent: Dec. 3, 1985

[54] DEFLECTION YOKE FOR SMALL GUN-BASE CRT

[75] Inventor: James H. Logan, Chesapeake, Va.

[73] Assignee: General Electric Company, Portsmouth, Va.

[21] Appl. No.: 656,809

[22] Filed: Oct. 1, 1984

[51] Int. Cl.[4] ..... H01F 7/10

[52] U.S. Cl. ..... 335/210; 335/213; 313/331; 313/440

[58] Field of Search ..... 335/210, 212, 213; 313/426, 427, 428, 431, 440

[56] References Cited

U.S. PATENT DOCUMENTS

| | | | |
|---|---|---|---|
| 2,925,542 | 2/1960 | Gethmann . | |
| 3,430,099 | 2/1969 | Ashley . | |
| 3,735,193 | 5/1922 | Ikeuchi | 335/213 |
| 4,117,434 | 9/1978 | Logan . | |
| 4,143,346 | 3/1979 | Borkar . | |
| 4,217,566 | 8/1980 | Hamano . | |
| 4,233,582 | 11/1980 | Abe . | |
| 4,246,560 | 1/1981 | Shimizu et al. . | |
| 4,257,023 | 3/1981 | Kamijo | 335/210 X |
| 4,305,055 | 12/1981 | Marett | 335/210 X |
| 4,401,917 | 8/1983 | Gerritsen . | |
| 4,409,578 | 10/1983 | Beelaard et al. | 335/210 |
| 4,415,831 | 11/1983 | Konosu . | |
| 4,420,734 | 12/1983 | Shimizu et al. . | |
| 4,431,940 | 2/1984 | Habraken et al. . | |
| 4,433,268 | 2/1984 | Arisato . | |
| 4,433,318 | 2/1984 | Okuyama et al. . | |

OTHER PUBLICATIONS

Kaashoak, "A Study of Magnetic-Deflection Errors", Technical University of Eindhoven, Jul., 1968, N.V. Phillips Research Reports.

Maruyama et al., "Pincushion Distortion-Free Self--Convergence Deflection System", Hitachi, Ltd., Tokyo Japan.

"Deflection Yoke for Dynamic Raster Distortion Correction Free Color Picture Tube", Toshiba New Product Information.

*Primary Examiner*—George Harris

[57] ABSTRACT

A magnetic deflection yoke is designed for use with a three gun 100° in-line cathode ray tube (5) having a gun base no longer than 5.9 mm and achieves self-convergence and four-sided pincushion correction by means of the cathode ray tube and yoke only. The yoke includes a set of segmented saddle-type horizontal deflection coils (8) and a set of toroidal-type vertical deflection coils (4) which are wound on a permeable core (3) surrounding the horizontal deflection coils. An insulating coilform (1) between the horizontal and vertical deflection coils supports the coils and facilitates their mounting to the neck portion of the cathode ray tube envelope. Magnetic field collectors (6) essentially surround the vertical deflection coils and directs the magnetic lines of flux through the cathode ray tube envelope to produce a linear vertical deflection of the cathode ray beam. Magnetic field shunts (7) are located between the vertical deflection coil and the insulating coilform and modify the magnetic lines of flux through the cathode ray tube envelope to produce a linear horizontal deflection of the cathode ray beam. The vertical deflection coils are wound so as to achieve a positive third harmonic coefficient and the horizontal deflection coil winding distribution is tailored to achieve, in combination with the magnetic field collectors and the magnetic field shunts, self-convergence and four-sided pincushion correction.

3 Claims, 5 Drawing Figures

DEFLECTION YOKE FOR SMALL GUN-BASE CRT

BACKGROUND OF THE INVENTION

The present invention is generally related to deflection yokes for cathode ray tube (CRT) displays and, more particularly, to a very wide angle deflection yoke for use with a small gun-base, in-line CRT display system.

Examples of prior art deflection systems to which the invention is related are disclosed in U.S. Pat. Nos. 3,430,099 issued to R. B. Ashley, 2,925,542 issued to R. B. Gethman, 4,217,566 issued to Eizaburo Hamano, and 4,143,346 issued to S. R. Borkar. Ashley discloses a deflection system in which self convergence of vertical lines is produced by outside electron beams. Gethman teaches the analytical discription of deflection yoke windings. Hamano teaches pin cushion correction by means of permanent magnets. Borkar teaches the use of segmented saddle type windings in a combination with a toriodal yoke.

As evidenced by the foregoing, it is well known how deflection in a CRT display is accomplished. Basically, two sets of magnetic poles, orthogonally aligned to each other and having simple winding distributions, are required to accomplish the deflection function. The general principles of the design of deflection coils are presented in Chapter 18 entitled "Deflection Coils" in *Television Engineering* by A. M. Dhake, McGraw-Hill (1979). In my prior U.S. Pat. No. 4,117,434, I disclosed a hybrid deflection system for a CRT in which toroidal-type quadripolar correction coils, having areas vacant of any windings within the coils, lie wound in accordance with a Fourier series winding distribution on a split ring magnetic core of the deflection system comprising saddle-type horizontal deflection coils and toroidal-type vertical deflection coils. The winding distribution of such non-distorting deflection coils is given by the following equation:

$$n(\theta-\beta)=NA_1\sin(\theta-\beta) \quad (1)$$

where $n(\theta-\beta)$ represents the number of turns of wire encompassed by the angle $(\theta-\beta)$ in a quadrant of the core between the X and Y axes, N is the total number of windings in th quadrant, and $A_1$ is the Fourier coefficient. $\theta$ varies from 0° to 180° for horizontal coils and from 90° to 270° for vertical coils. For the horizontal case, for example, when $\theta=90°$, $n=N$, and when $\theta=180°$, $n=0$. $\beta=0°$ for horizontal coils, and $\beta=90°$ for vertical coils. The deflection winding distribution can be designed to effect convergence of off-axis (outside) beams when the winding distribution obeys the following equation:

$$n(\theta-\beta)=N[A_1\sin(\theta-\beta)+A_3\sin(3\theta-\beta)+A_k\sin(k\theta-\beta)] \quad (2)$$

where $A_1$, $A_3 \ldots A_k$ are Fourier coefficients. The on-axis (center) beam can be made to converge with the off-axis beams by use of magnetic shunts in the CRT when the result of converging off-axis beams is a center beam convergence error. If the winding distribution is a constant throughout the coil, means for pincushion distortion correction, external to the deflection coils, may be required. This is always true in the case of left and right pincushion correction since the vertical coil winding distribution coefficient, $A_3$, is positive for pincushion correction and negative for self convergence.

Winding distributions can be made variant with axial position so that the distributions are given by the following equation:

$$n(z,\theta-\beta)=N[A_1(z)\sin(\theta-\beta)+A_3(z)\sin(3\theta-\beta)-+A_k(z)\sin(k\theta-\beta)] \quad (3)$$

where z is the length along the CRT axis. This is convenient since display distortions are related to the axial position at which particular winding distributions occur. The general fact of these relationships has been well known to those practiced in the field and was formalized by Kaashoak in his thesis entitled "A Study of Magnetic-Deflection Errors", Techinical University Eindhoven, July 1968, N. V. Philips Research Reports.

Those working at Toshiba and Hitachi demonstrated that actual winding distributions can be functionally altered by use of magnetic shunts adjacent to the winding. See for example "Deflection Yoke for Dynamic Raster Distortion Correction Free Color Picture Tube", Toshiba New Product Information, and "Pincushion Distortion-Free Self-Convergence Deflection System", by Takesuke Maruyama et al, Hitachi, Ltd., Tokyo, Japan. Phillips has used segmented windings to achieve particular saddle coil distributions starting with 25V displays having delta gun configurations. Toshiba has produced yokes in which the low frequency magnetic field external to the yoke is collected and redirected to correct pincushion. Using these techniques and that of CRT magnetic shunt use, self converging, pincushion correcting deflection systems have been designed. These systems worked well with gun bases as small as 6.6 mm and deflection angles as large as 100°. However, there has been difficulty in reaching 110° deflection angles with the prior art systems.

SUMMARY OF THE INVENTION

It is therefore a principle object of the present invention to provide pincushion correction for a wide angle, in-line CRT display system.

It is another more specific object of the invention to provide a 110° deflection yoke for use with a small gun-base CRT that achieves both pincushion correction and self-convergence.

The objects of the invention are accomplished by combining magnetic flux collectors and magnetic flux shunts in the yoke with positive vertical yoke coil third harmonic coefficient, segmented horizontal yoke coils, tailored horizontal coil distribution and CRT magnetic shunts to achieve self-convergence and four-sided pincushion correction in a 110° three beam in-line CRT by means of the CRT and yoke only. In order to achieve pincushion correction and self-convergence in a 110 deflection system, the design according to the present invention requires a smaller gun base. The new 5.1 mm gun base produced by RCA can be used in the practice of the invention as can the 4.8 mm gun bases in 22.5 mm neck CRTs. The gun base is important to the design bacause there is a relationship between gun base and convergence errors that is expressed as follows:

$$e_1/e_2=(g_1/g_2)^{[5/3]} \quad (4)$$

where $e_1$ and $e_2$ are convergence errors and $g_1$ and $g_2$ are intergun spacings. The invention accomplishes the following functions:

(1) Deflection of three in-line cathode ray tube beams to a diagonal angle of approximately 110°.

(2) Convergence of three in-line electron beams in a cathode ray tube.

Correction of pincushion distortion at top, bottom, left and right CRT display sides.

BRIEF DESCRIPTION OF THE DRAWINGS

The foregoing and other objects, aspects and advantages of the invention will be better understood from the following detailed description of the invention with reference to the drawings, in which.

DETAILED DESCRIPTION OF THE INVENTION

The invention is a magnetic deflection yoke for a horizontal three gun 110° in-line cathode ray tube having a set of saddle-type innermost coils. The saddle-type coils have a winding distribution given by equation (3) which is achieved by means of segmented windings, planar winding boundaries and permeable shunts so that self-convergence is achieved along the deflection axis and in off-axis locations, and pincushion correction at the top and bottom of the display is achieved. The magnetic deflection system further comprises a toroidally wound outer set of coils whose mmf distribution is synthesized to emulate a winding distribution given by equation (3) by means of electrically conductive and magnetically permeable shunts adjacent to the coil. A set of magnetically permeable magnetic field collection and distribution members are arranged about the large diameter yoke end so as to correct pincushion errors. The basic construction of saddle-type horizontal deflection coils and the vertical deflection coils is disclosed in my prior U.S. Pat. No. 4,117,434 which is incorporated herein by reference.

Figure 1:
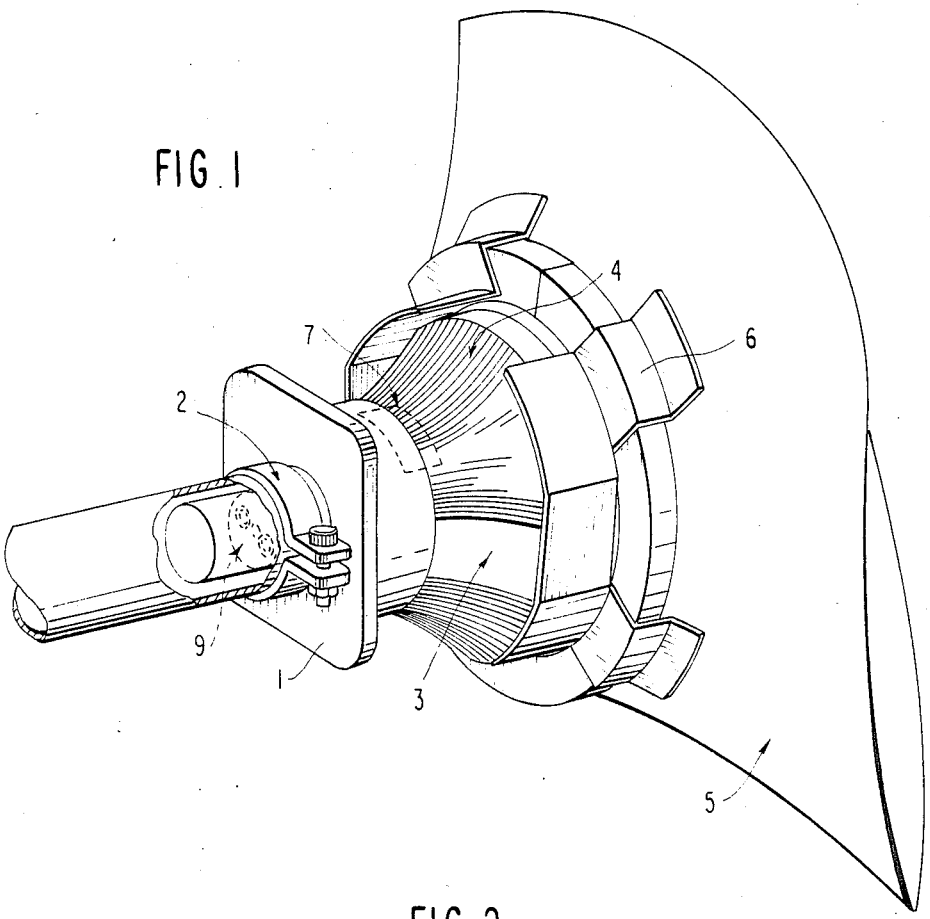
FIG. 1 is a perspective view depicting the essential elements of the invention.
Figure 2:
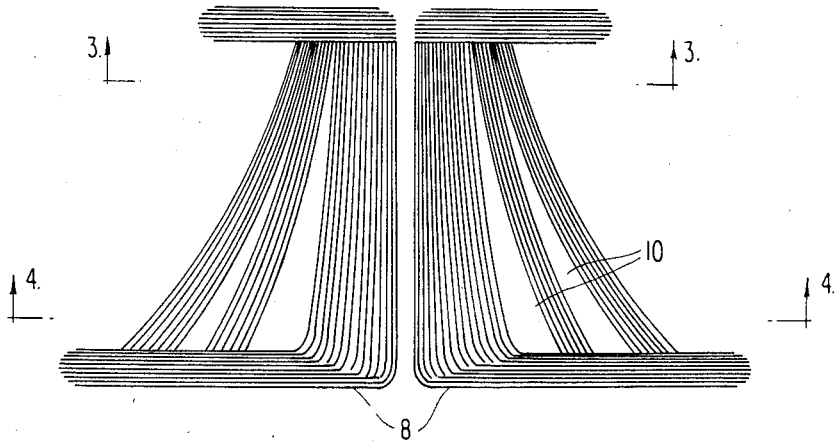
FIG. 2 is a plan view of the saddle-type coils segmented by winding voids.

As shown in FIGS. 1 and 2, the innermost saddle-type coils 8 (shown in FIG. 2) and torodial-type coils 4 (shown in FIG. 1) are separated by a suitable insulating coilform 1. A clamp or other suitable means 2 attaches the yoke to the CRT. The vertical coils 4 are wound on a permeable core 3 which surrounds the saddle-type coils 8, and a magnetic field collector set 6 essentially surrounds the vertical coils 4. A magnetic field shunt set 7 is located between the vertical coils 4 and the insulating coilform 1. This yoke assembly is attached to the CRT 5 which has an electron gun 9 with a gun base of at most 5.9 mm and magnetic shunts. The magnetic field collectors 6 conform closely to the vertical coils 4 on opposite sides of the yoke assembly and tends from one coil to the other of the vertical coil pair. The field shaper and the shunt portions of the field collectors 6 are in the form of projecting ears at either end of each collector. These projecting ears extend along and are parallel to the CRT envelope funnel. The thus collected lines of flux are directed through the envelope of the CRT from the projecting ear of one collector to the adjacent projecting ear of the other collector. The magnetic field shunts 7 are diametrically opposed in the vertical direction and modify the field of the vertical windings to appear as if the turns which are shunted do not exist.

Figure 3:
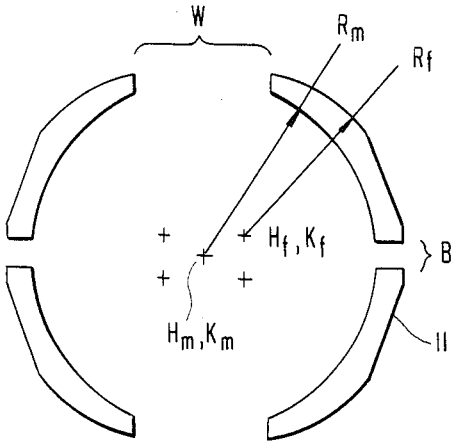
FIG. 3 is a cross-sectional view taken along section line 3—3 in FIG. 2.
Figure 4:
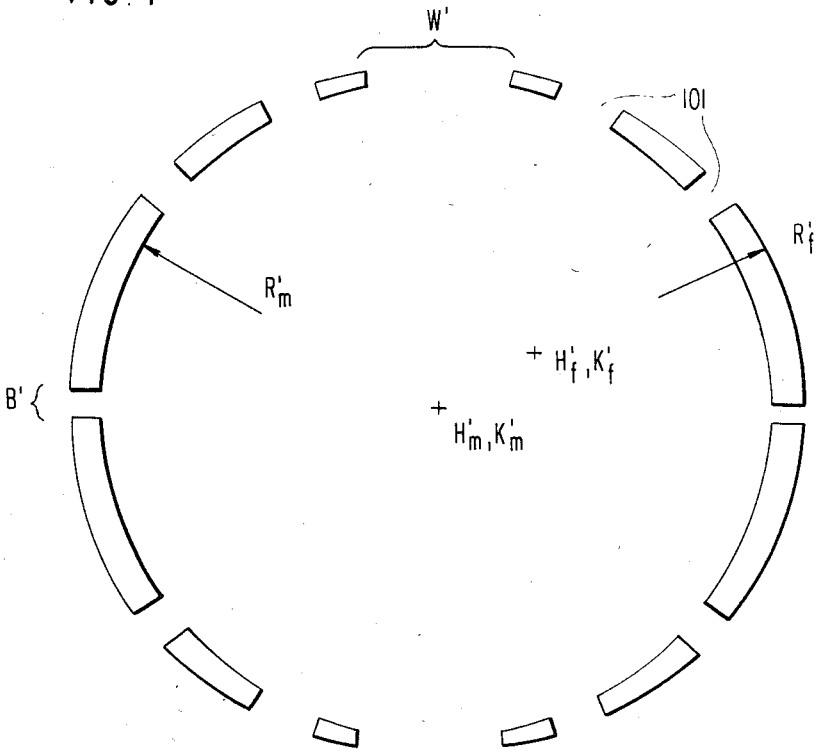
FIG. 4 is a cross-sectional view taken along section line 4—4 in FIG. 2.

As shown more particularly in FIG. 2, the segmented saddle-type coils 8 are segmented by voids 10. FIG. 3 depicts a linear winding boundary 11 in the saddle coil 8 at section 3—3 of FIG. 2, while FIG. 4 depicts the saddle coil at section 4—4 showing the segments formed by voids 10. The saddle-type coil 8 is made using linear boundaries 11 in concert with arc boundaries $R_m$ and $R_f$ as well as void boundaries W and B to achieve the particular coefficients of equation (3) on the Z axis at the point of the section line 3—3. As will be understood by those skilled in the art, the radius $R_m$ refers to the male radius and the radius $R_f$ refers to the female radius. The center for the male radius is coincident with the Z axis, which is the axis of the CRT, with X and Y coordinates $H_m$ and $K_m$, respectively. The center of the female radius having X and Y coordinates $H_f$ and $K_f$ can be selected arbitrarily and may be made a functiuon of Z. Generally, this center is choosen empirically to achieve the particular coefficients of equation (3). The primary goal in this region is the correction of coma at left and right. Segmented windings 8 along with other coil boundaries $R'_m$, $R'_f$, W' and B' are used to realize particular equation (3) coefficients throughout the remaining coil parts as shown in FIG. 4. This complexity is required to simultaneously achieve major axis convergence, corner convergence and top and bottom pincushion correction. Major axis convergence and pincushion correction each require that the coefficient $A_3$ of equation (3) be positive, which is easily achieved by specifying W and B. Coefficients $A_5$ and $A_7$ have values that are achieved primarily by the use of segmented windings.

Toroidal coil 4 is wound with equation (3) coefficient $A_3$ more positive than is apparently required by vertical self convergence requirements. The magnetic field shunt set 7 causes the field to behave as though it were wound with $A_3$ having the proper negative value. Toroidal coils 4 have an external field, that is gathered by magnetic field collector 6, and winding distribution coefficients $A_k$ that are adjusted to produce minor axis convergence, corner convergence and left and right pincushion correction.

Figure 5:
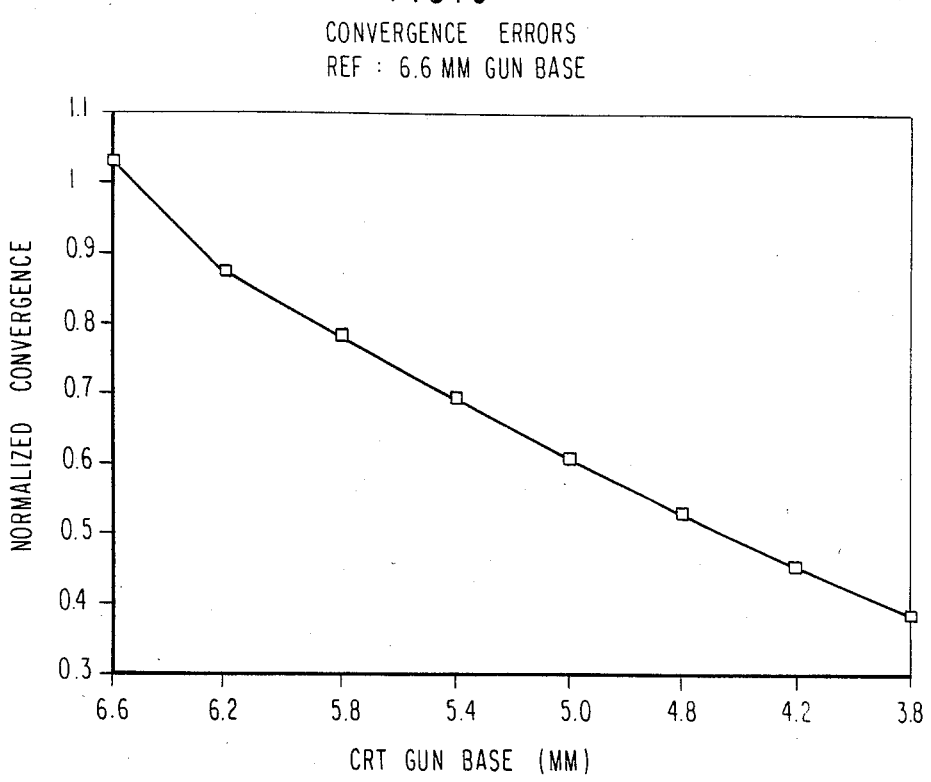
FIG. 5 is a graph of convergence errors plotted with the normalized convergence as a function of gun base size.

The range of gun bases over which the invention has application is that group of practical dimensions less than 5.9 mm as shown in the graph of FIG. 5. The coefficients are calculated using Fourier analysis on the summation of Ampere-turns as a function of the angle ($\theta$) in equations (5), (6) and (7), below. Since the deflection Ampere-turn distribution, about the CRT, is represented by an odd function, the Fourier coefficients are given by Euler's formula for odd functions:

$$A_n = \frac{1}{\pi} \int_0^{2\pi} f(\theta)\sin(n\theta)d\theta. \quad (5)$$

where n is the Fourier coefficient index, $A_n$ is the nth Fourier coefficient, and $f(\theta)$ is the mathematical expression which describes the Ampere-turns accumulation as a function of the angular position on the CRT. In some cases, the Ampere-turns distribution is simple enough that equation (5) results in a reasonable expression. The general case is complicated and is best solved by a numerical integration technique. One such technique is to use a computer program to calculate the coefficients using equation (5) in the summation form:

$$A_n = (1/A_1) \sum_{s=1}^{s=S} t_s \sin(n\theta), \quad (6)$$

where n is the Fourier coefficient index, $A_n$ is the nth Fourier coefficient, and $A_1$ is given by the following expression:

$$A_1 = \sum_{s=1}^{s=S} t_s \sin(\theta), \quad (7)$$

where S is the total number of winding positions encompassing the CRT, s is a particular winding position, and $t_s$ is the number of turns to and including the winding position s. Such an approach can be programmed using the BASIC programming language. First, the following definitions and constraints are made:

(a) The winding distribution is symmetrical about the X and Y axes.

(b) All turns are in series with each other.

(c) The turns at each winding position have been determined and stored in a single dimension matrix, N(I).

(d) M1 is the winding positions in 90 degrees.

(e) C is defined as PI/(2*M1).

(f) The odd numbered coefficients are calculated since the even ones are 0.

(g) Only the first four coefficients are calculated for simplicity.

Based on the foregoing definitions and constraints, the computer program in BASIC is as follows:

```
500 FOR I=1 TO M1
510 N9=N9+N(I)
520 A=I*C
530 IF I<M1 THEN 550
540 N9=N9/2
550 Al =Al+N9* SIN(A)
560 A3=A3+N9* SIN(3*A)
570 A5=A5+N9* SIN(5*A)
580 A7=A7+N9* SIN(7*A)
600 NEXT I.
```

The required coefficients are determined experimentally by constructing deflection coils of various distributions and observing the effects that these distributions have on raster distortions. This process proceeds by the use of overwindings and by the use of temporary additions to the winding abors which alter the winding space and thus the distributions. From this work there arise clear relationships between the spacial distributions and the raster distortions. These relationships are used to establish the final distribution.

The magnetic shunts 7 and field shapers 6 designs likewise result from experimentally derived relationships between configuration and raster distortions. The front and rear field shaper relationships between configuration and raster distortions have a first order dependance on the vertical deflection coil distribution and thus the superposition of effects is applied with due regard for the applicable relationships. With the relationships between winding distributions and field shaper and distortions established, these relationships are combined to produce the final design.

In a specific embodiment of the invention which has been reduced to practice, the CRT 5 has a 5.1 mm gun base to yield inherently small convergence errors. The prototype design has the following vertical distribution coefficients which are constant front to back:

$A_1 = 1.10$
$A_3 = 0.06$
$A_5 = -0.039$
$A_7 = -0.002$

The following horizontal distribution coefficients are estimated since saddle-type windings from a RCA yoke were used:

$A_1$ = approximately 1 from rear to front
$A_3 = -0.05$ in the rear non-linearly increasing to 0.20 at front
$A_5 = -0.03$ in the rear non-linearly increasing to 0.04 at front.

The forward vertical field collectors 6 consists of a collector that conforms closely to the vertical coils 4 over an arc starting 20° from the winding center of one coil and extending 140° to 20° from the center of the other coil in the deflection pair. The projecting ears occupy 42° of arc each and extend 0.25 inch along and parallel to the CRT funnel. The field shunts 7 each consists of a shunt that occupies 82° of arc and extend 0.5 inch along the CRT neck.

While the foregoing constitutes a specific example of a yoke construction for a 110° CRT having a 5.1 mm gun base, those skilled in the art will understand from the teachings of this disclosure how construct yokes for other 110° CRTs having different gun base dimensions. The successful practice of the invention, however, is predicated on gun base dimensions no greater than 5.9 mm.

I claim:

1. A magnetic deflection yoke which achieves both self-convergence and four-sided pincushion correction in a three gun 110° in-line cathode ray tube having an envelope comprising a neck portion and a funnel portion, said neck portion of the cathode ray tube envelope housing a gun base no larger than 5.9 mm, said deflection yoke comprising:

a set of saddle-type innermost coils and a pair of torodial-type vertical deflection coils, said set of saddle-type horizontal deflection coils being segmented and having flanged ends with the radius of one end being larger than the other to conform to the shape of the funnel portion of the cathode ray tube envelope, the radius of the other end conforming to the diameter of said neck portion;

a permeable core surrounding said set of saddle-type horizontal deflection coils onto which said pair of vertical deflection coils are wound, said pair of vertical deflection coils being wound with a positive third harmonic Fourier coefficient;

an insulating coilform between said set of horizontal deflection coils and said pair of vertical deflection coils for supporting said coils and facilitating their mounting to said neck portion of the cathode ray tube envelope;

magnetic field collector means comprising collector means essentially surrounding said vertical deflection coils and field shaper and shunt means extending along and parallel to the funnel portion of the cathode ray tube envelope for directing lines of magnetic flux through the cathode ray tube envelope; and magnetic field shunt means positioned between said vertical deflection coils and said insulating coilform for modifying the field of said pair of vertical windings so that it behaves as though it were wound with negative third harmonic Fourier coefficient value.

2. The magnetic deflection yoke as recited in claim 1 wherein the winding distribution is given by the equation $$n(z,\theta=\beta)=N[A_1(z)\sin(\theta-\beta)+A_3(z)\sin(3\theta-\beta)+A_k(\sin k\theta-\beta)]$$

where $n(z,\theta-\beta)$ represents the number of turns encompassed by an angle $\theta$ in a quadrant between the X and Y axes, N is the total number of windings in the quadrant, and $A_1$, $A_3 \ldots A_k$ are Fourier coefficients, said effective winding distribution being by means of segmented windings, planar winding boundaries and said magnetic field collector means and said magnetic shunt means, so that self-convergence is achieved along the deflection axis and in off-axis locations and pincushion correction at the top and bottom of the display is achieved.

3. The magnetic deflection yoke as recited in claim 2 wherein the Fourier coefficients for the vertical distribution are $A_1=1.10$, $A_3=0.06$, $A_5=-0.039$, and $A_7=-0.002$, constant from front to back, and the horizontal distribution coefficients are $A_1$=approximately 1 from front to rear, $A_3=-0.05$ in the rear increasing non-linearly to 0.20 at the front, and $A_5=-0.03$ in the rear increasing non-linearly to 0.20 at the front, said field collector means conforms closely to said vertical coils over an arc starting 20° from the winding center of one coil of the pair and extends 140° to 20° from the center of the other coil of the pair and said field shaper and shunt means includes four portions that occupy 42° of arc each and extend 0.25 inch long and parallel to the funnel portion of the cathode ray tube envelope, and said magnetic field shunt means consists of a shunt that occupies 82° of arc and extends 0.5 inch long the cathode ray tube neck portion of the envelope.

* * * * *